US011698071B2

(12) United States Patent
Lazzerini et al.

(10) Patent No.: US 11,698,071 B2
(45) Date of Patent: Jul. 11, 2023

(54) VARIABLE DISPLACEMENT LUBRICANT PUMP

(71) Applicant: PIERBURG PUMP TECHNOLOGY GMBH, Neuss (DE)

(72) Inventors: Massimiliano Lazzerini, Cecina (IT); Carmine Cuneo, Pisa (IT); Fabio Guglielmo, Ponsacco (IT); Vincenzo Zaccuri, Ponsacco (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 29 days.

(21) Appl. No.: 17/614,379

(22) PCT Filed: May 29, 2019

(86) PCT No.: PCT/EP2019/063967
§ 371 (c)(1),
(2) Date: Nov. 26, 2021

(87) PCT Pub. No.: WO2020/239216
PCT Pub. Date: Dec. 3, 2020

(65) Prior Publication Data

US 2022/0228588 A1 Jul. 21, 2022

(51) Int. Cl.
*F03C 2/00* (2006.01)
*F03C 4/00* (2006.01)
(Continued)

(52) U.S. Cl.
CPC ..... *F04C 14/22* (2013.01); *F04C 2/3442* (2013.01); *F04C 2210/14* (2013.01); *F04C 2240/50* (2013.01)

(58) Field of Classification Search
CPC ..... F04C 2/3442; F04C 14/10; F04C 14/20; F04C 14/22; F04C 14/223; F04C 2210/14;
(Continued)

(56) References Cited

U.S. PATENT DOCUMENTS

2016/0138592 A1* 5/2016 Moriglia ..... F04C 14/223 418/26
2016/0363120 A1* 12/2016 Meinig ..... F04C 14/223
(Continued)

FOREIGN PATENT DOCUMENTS

JP 57168790 U * 10/1982 ..... F04C 14/223
JP 05126065 A * 5/1993 ..... F04C 14/223
(Continued)

OTHER PUBLICATIONS

JP57168790U—N/A—No Title Available—Oct. 23, 1982—English Machine Translation (Year: 1982).*
(Continued)

*Primary Examiner* — Theresa Trieu
(74) *Attorney, Agent, or Firm* — Norman B. Thot

(57) ABSTRACT

A variable displacement lubricant pump includes a housing, a control ring arranged in the housing, an inlet chamber and an outlet chamber, and a lateral slide bearing. The control ring is shiftable, radially confines a pumping chamber, and comprises a drainage channel. The outlet chamber and the inlet chamber are arranged at opposite lateral sides of the control ring. The lateral slide bearing is arranged at the lateral side of the control ring where the outlet chamber is arranged and comprises a first lateral slide bearing surface defined by the static housing, a second lateral slide bearing surface arranged opposite to the first lateral slide bearing surface which is defined by the control ring, and a lateral slide bearing gap defined between the first and second lateral
(Continued)

slide bearing surfaces. The drainage channel of the control ring fluidically connects the lateral slide bearing gap with the inlet chamber.

4 Claims, 2 Drawing Sheets

(51) Int. Cl.
*F04C 2/00* (2006.01)
*F04C 14/22* (2006.01)
*F04C 2/344* (2006.01)

(58) Field of Classification Search
CPC ..... F04C 2210/206; F04C 2240/50; F04C 2240/102; F01C 21/0863
See application file for complete search history.

(56) References Cited

U.S. PATENT DOCUMENTS

2017/0321696 A1* 11/2017 Nagasaka ..... F04C 2/3442
2020/0300092 A1* 9/2020 Lazzerini ..... F04C 14/223

FOREIGN PATENT DOCUMENTS

WO WO 2014/198322 A1 12/2014
WO WO 2018/196991 A1 11/2018
WO WO 2019/091559 A1 5/2019

OTHER PUBLICATIONS

JP05126065A—Abe et al.—Variable Capacity Type Vane Pump—May 21, 1993—English Machine Translation (Year: 1993).*

* cited by examiner

VARIABLE DISPLACEMENT LUBRICANT PUMP

CROSS REFERENCE TO PRIOR APPLICATIONS

This application is a U.S. National Phase application under 35 U.S.C. § 371 of International Application No. PCT/EP2019/063967, filed on May 29, 2019. The International Application was published in English on Dec. 3, 2020 as WO 2020/239216 A1 under PCT Article 21(2).

FIELD

The present invention is directed to a variable displacement lubricant pump for providing a pressurized lubricant. The present invention is in particular directed to a mechanical variable displacement lubricant pump for providing a pressurized lubricant for an internal combustion engine.

BACKGROUND

The lubricant pump is mechanically driven by the engine, for example, via a gear or belt, and is fluidically coupled to the engine for pumping the pressurized lubricant to and through the engine. The variable displacement of the lubricant pump allows a pump discharge pressure of the lubricant pump to be controlled and/or stabilized, and thereby allows, for example, a lubricant galley pressure in the engine to be controlled and/or stabilized.

WO 2018/196991 A1 describes a typical variable displacement lubricant pump for providing a pressurized lubricant for an internal combustion engine. The lubricant pump comprises a static pump housing and a shiftable control ring which is arranged within the pump housing which radially confines a cylindrical pumping chamber. The lubricant pump comprises an inlet chamber and an outlet chamber both being partially confined by the control ring and located at opposite lateral sides of the control ring. The lubricant pump comprises a lateral slide bearing located at the outlet-chamber-sided lateral side of the control ring. The lateral slide bearing comprises a first lateral slide bearing surface which is defined by the pump housing and an opposite second lateral slide bearing surface which is defined by the control ring. The lateral slide bearing gap formed between the two vertical slide bearing surfaces is fluidically sealed by a sealing element to avoid leakage of pressurized lubricant via the lateral slide bearing gap. An undesired lubricant leakage via the lateral bearing gap can impair the pump discharge pressure control and/or the pump performance, in particular if the lateral bearing gap fluidically leads into a hydraulic control chamber of the lubricant pump. However, the sealing element increases the slide friction of the lateral slide bearing and thereby reduces the pump's efficiency. The pump housing and/or the control ring must furthermore be provided with a specific holding device to hold the sealing element in place and to avoid a slipping of the sealing element out of the lateral slide bearing gap.

SUMMARY

An aspect of the present invention is to provide a cost-efficient, reliable, and efficient variable displacement lubricant pump.

In an embodiment, the present invention provides a variable displacement lubricant pump for providing a pressurized lubricant. The variable displacement lubricant pump includes a static pump housing, a control ring which is arranged within the static pump housing, an inlet chamber which is partially confined by the control ring, an outlet chamber which is partially confined by the control ring, and a lateral slide bearing. The control ring is configured to be shiftable and to radially confine a pumping chamber which is substantially cylindrical. The control ring comprises a drainage channel. The outlet chamber and the inlet chamber are arranged at opposite lateral sides of the control ring. The lateral slide bearing is arranged at the lateral side of the control ring where the outlet chamber is arranged. The lateral slide bearing comprises a first lateral slide bearing surface which is defined by the static pump housing, a second lateral slide bearing surface which is arranged opposite to the first lateral slide bearing surface and which is defined by the control ring, and a lateral slide bearing gap which is defined between the first lateral slide bearing surface and the second lateral slide bearing surface. The drainage channel of the control ring fluidically connects the lateral slide bearing gap with the inlet chamber.

BRIEF DESCRIPTION OF THE DRAWINGS

The present invention is described in greater detail below on the basis of embodiments and of the drawings in which.

DETAILED DESCRIPTION

Figure 1:
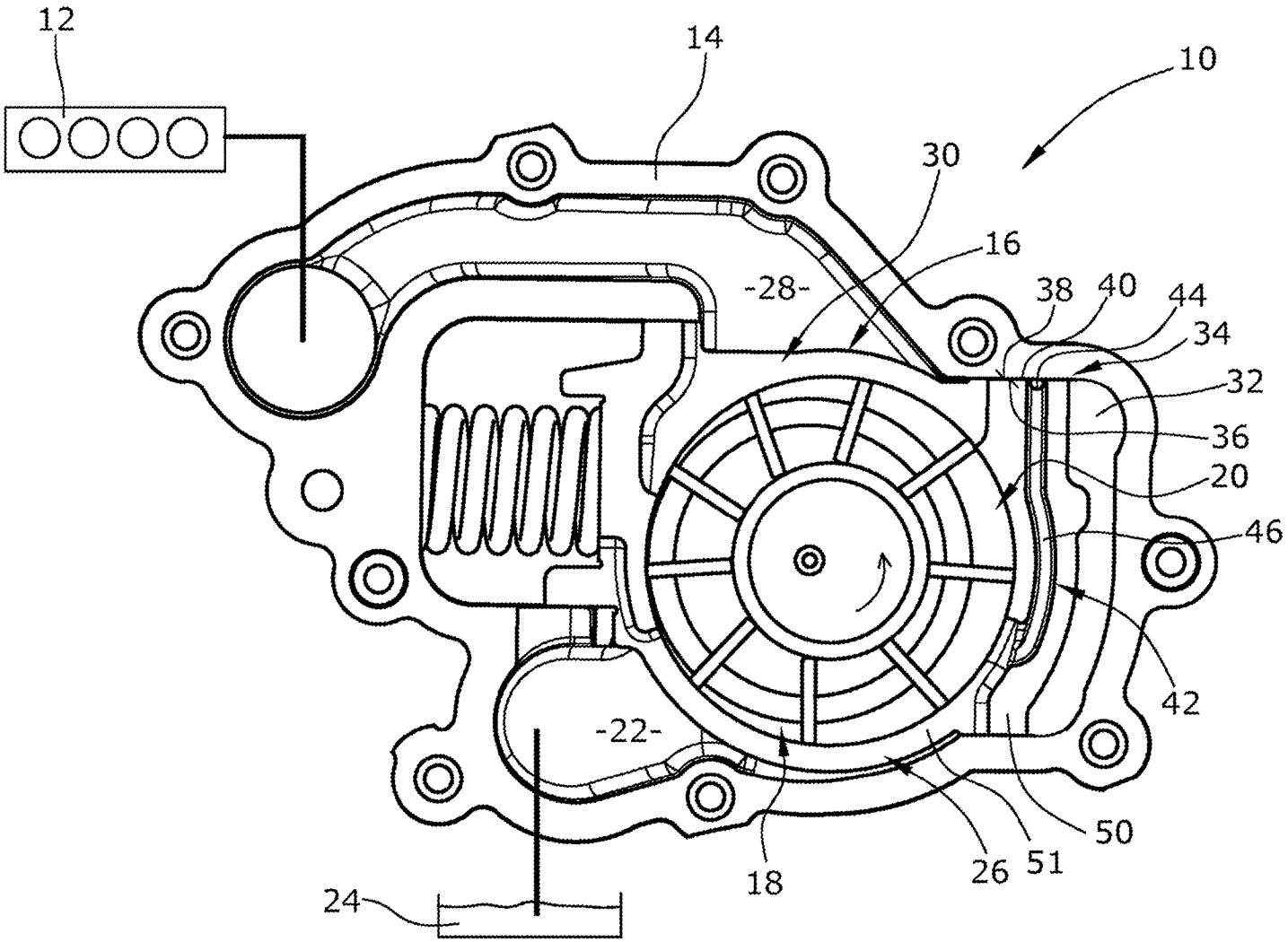
FIG. 1 shows a top view of an opened variable displacement lubricant pump according to the present invention.
Figure 2:
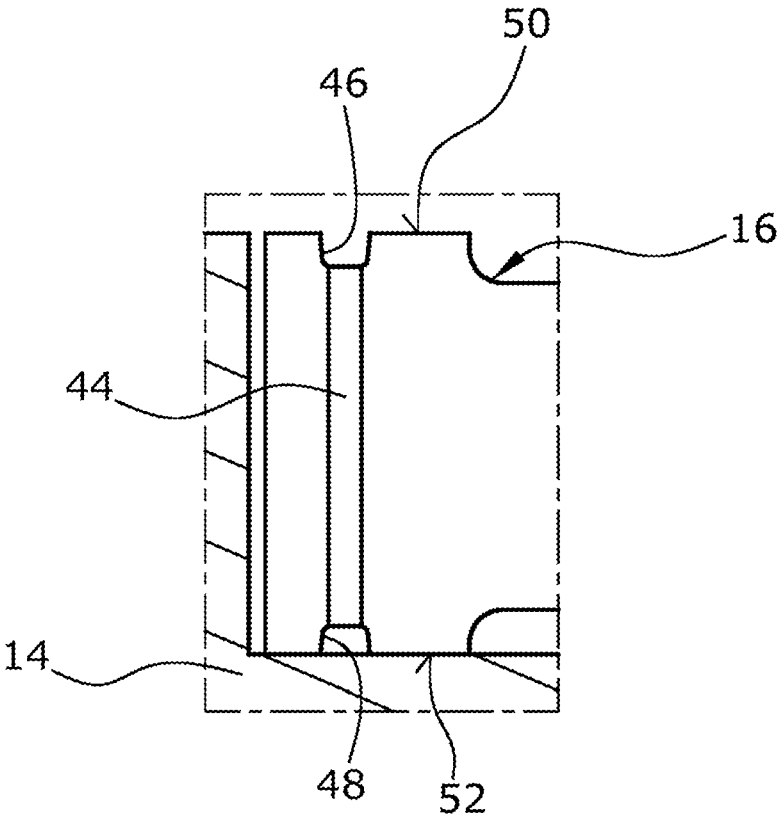
FIG. 2 shows a partially sectioned side view of a control ring section and a pump housing section of the lubricant pump of FIG. 1.

The variable displacement lubricant pump according to the present invention is provided with a static pump housing which defines a pump inlet and a pump outlet. The pump inlet is typically fluidically connected with a lubricant tank, and the pump outlet is fluidically connected with an engine for providing the engine with the pressurized lubricant.

The variable displacement lubricant pump according to the present invention is also provided with a shiftable control ring which is arranged within the pump housing. The control ring radially confines a substantially cylindrical pumping chamber. The control ring can, for example, be linearly shiftable with respect to the pump housing, but the control ring is in any case not pivotably hinged within the pump housing. The pumping chamber is typically provided with an exactly circular radial cross section. The pumping chamber can, however, also be provided with a non-exactly circular radial cross section (for example, with a slightly elliptical cross section) to improve the pump efficiency and/or the pump pressure control.

The variable displacement lubricant pump according to the present invention is also provided with an inlet chamber and with an outlet chamber which are both partially confined by the control ring and partially confined by the pump housing. The inlet chamber and the outlet chamber are located radially outwardly of the pumping chamber at opposite lateral sides of the control ring. The inlet chamber is fluidically connected with the pump inlet, and the outlet chamber is fluidically connected with the pump outlet. During pump operation, the inlet chamber is filled with lubricant having a relatively low pressure; the inlet chamber is typically filled with a lubricant substantially having atmospheric pressure. The outlet chamber is filled with pressurized lubricant during pump operation.

The variable displacement lubricant pump according to the present invention is also provided with a lateral slide bearing which is located at the outlet-chamber-sided lateral side of the control ring and via which the control ring is frictionally supported within the pump housing. The lateral slide bearing comprises two parallel and opposite lateral slide bearing surfaces, a first lateral slide bearing surface defined by the pump housing, and a second lateral slide bearing surface defined by the control ring. Both lateral slide bearing surfaces each extend in a pump plane which is parallel to the sliding direction of the control ring as well as to the axial direction of the cylindrical pumping chamber. A typically relatively narrow lateral slide bearing gap is formed between the two corresponding lateral slide bearing surfaces. The lateral slide bearing is typically located between the outlet chamber and a control chamber, wherein the control ring position and, as a result, the volumetric pump performance, is controlled via the hydraulic pressure of the control chamber.

According to the present invention, the control ring is provided with a drainage channel which fluidically connects the lateral slide bearing gap with the inlet chamber. The drainage channel can directly lead into the inlet chamber or alternatively can lead into a pump region which is in fluidic contact with the inlet chamber. The drainage channel is in any case provided substantially with the inlet chamber pressure. Pressurized lubricant which is pressed into the lateral slide bearing gap from the outlet chamber is as a result reliably conveyed out of the lateral slide bearing and toward the low-pressure inlet chamber. This avoids or at least significantly suppresses a lubricant leakage via the lateral slide bearing into the adjoining hydraulic chamber, for example, into the control chamber, not requiring any separate sealing element in the lateral slide bearing gap.

The variable displacement lubricant pump according to the present invention provides a reliable and efficient pump operation. The variable displacement lubricant pump according to the present invention can be realized very cost-efficiently since no sealing element is required to seal the lateral slide bearing.

The drainage channel can, for example, be partially defined by a lateral groove which is provided within the second lateral slide bearing surface of the control ring and which is fluidically connected with the inlet chamber. The lateral groove can, for example, extend over the entire axial height of the control ring and, as a result, over the entire axial height of the lateral slide bearing to efficiently collect any lubricant which leaks into the lateral slide bearing gap. The lateral groove can be realized cost-efficiently and allows for a reliable avoidance of lubricant leakage via the lateral slide bearing gap.

The control ring is typically frictionally supported within the pump housing also at its top side and its bottom side. In an embodiment of the present invention, a top-side slide surface of the control ring can, for example, be provided with top-side groove and/or a bottom-side slide surface of the control ring can, for example, be provided with bottom-side groove, wherein the top-side groove and/or the bottom-side groove as a result fluidically leads into the lateral groove and partially defines the drainage channel. The top-side groove and/or the bottom-side groove can, for example, lead into the inlet chamber or into a region which is in direct fluidic contact with the inlet chamber so that no additional arrangements are required in/at the control ring to fluidically connect the lateral slide bearing gap with the inlet chamber. This allows for a very cost-efficient realization of the drainage channel and thereby provides a cost-efficient lubricant pump. The top-side groove and/or the bottom-side groove also allows for a drainage of lubricant which leaks via the top side and/or the bottom side of the control ring. This minimizes the total lubricant leakage and thereby provides a very reliable and efficient lubricant pump.

The control ring is typically provided with a suction opening which fluidically connects the pumping chamber with the inlet chamber. The suction opening is typically provided via a top-side and/or a bottom-side recess within the control ring. The drainage channel can, for example, lead into the suction opening which is in direct fluidic contact with the inlet chamber. Since the suction opening typically extends over a relatively large circumferential sector of the pumping chamber, the drainage channel can be realized to be relatively short and thereby relatively cost-efficient.

An embodiment of the present invention is described below with reference to the enclosed drawings.

FIG. 1 shows a variable displacement lubricant pump 10 for providing a pressurized lubricant to an internal combustion engine 12. The lubricant pump 10 is provided with a static pump housing 14, with a shiftable control ring 16, and with a rotatable pump rotor 18. The control ring 16 is arranged within the pump housing 14 and radially confines a substantially cylindrical pumping chamber 20.

The lubricant pump 10 comprises an inlet chamber 22 which is fluidically connected with a lubricant tank 24 and which is filled with a lubricant having substantially atmospheric pressure during pump operation. The inlet chamber 22 is partially confined by the control ring 16 and is directly fluidically connected with the pumping chamber 20 via a suction opening 26 of the control ring 16.

The lubricant pump 10 comprises an outlet chamber 28 which is fluidically connected with the internal combustion engine 12 and which is filled with the pressurized lubricant during pump operation. The outlet chamber 28 is located at an opposite lateral side of the pumping chamber 20 with respect to the inlet chamber 22. The outlet chamber 28 is partially confined by the control ring 16 and is directly fluidically connected with the pumping chamber 20 via a discharge opening 30 of the control ring 16.

The lubricant pump 10 comprises a control chamber 32 which is located circumferentially between the inlet chamber 22 and the outlet chamber 28 at a front side of the control ring 16. During pump operation, the control chamber 32 is filled with lubricant, wherein the lubricant pressure within the control chamber 32 is controllable to thereby hydraulically control the position of the control ring 16 and, as a result, the volumetric pump performance.

The lubricant pump 10 comprises a lateral slide bearing 34 via which the control ring 16 is frictionally supported within the pump housing 14. The lateral slide bearing 34 is located at an outlet-chamber-sided lateral side of the control ring 16. The lateral slide bearing 34 directly adjoins the outlet chamber 28 as well as the control chamber 32 and thereby fluidically separates the control chamber 32 and the outlet chamber 28 from each other. The lateral slide bearing 34 comprises two parallel and opposite lateral slide bearing surfaces 36, 38 which are in a touching frictional contact with each other. The first lateral slide bearing surface 36 is defined by the pump housing 14, and the second lateral slide bearing surface 38 is defined by the control ring 16. The two lateral slide bearing surfaces 36, 38 define a lateral slide bearing gap 40 therebetween.

According to the present invention, the control ring 16 is provided with a drainage channel 42 which fluidically connects the lateral slide bearing gap 40 with the inlet chamber 22. In the shown embodiment of the present invention, the drainage channel 42 is formed and defined by a lateral groove 44, a top-side groove 46, and a bottom-side groove 48.

The lateral groove 44 is formed within the second lateral slide bearing surface 38 of the control ring 16. The lateral groove 44 extends substantially linear along the entire axial height of the control ring 16.

The top-side groove 46 is formed within a top-side slide surface 50 of the control ring 16. In the assembled (closed) pump, the top-side slide surface 50 is in frictional contact with a (not shown) pump housing cover body. The top-side groove 46 fluidically leads into the lateral groove 44 at one end and fluidically leads into a top-side region 51 of the suction opening 26 at its opposite end. The top-side groove 46 directly fluidically connects the lateral groove 44 with the suction opening 26 and thereby fluidically connects the lateral slide bearing gap 40 with the inlet chamber 22.

The bottom-side groove 48 is formed within a bottom-side slide surface 52 of the control ring 16. The bottom-side slide surface 52 is in frictional contact with the pump housing 14. The bottom-side groove 48 is shaped symmetrically to the top-side groove 46 in the shown embodiment of the present invention. The bottom-side groove 48 fluidically leads into the lateral groove 44 at one end, and fluidically leads into a (not shown) bottom-side region of the suction opening 26 at its opposite end. The bottom-side groove 48 directly fluidically connects the lateral groove 44 with the suction opening 26 and thereby fluidically connects the lateral slide bearing gap 40 with the inlet chamber 22.

The present invention is not limited to embodiments described herein; reference should be had to the appended claims.

LIST OF REFERENCE NUMERALS

10 Variable displacement lubricant pump
12 Internal combustion engine
14 Pump housing
16 Control ring
18 Pump rotor
20 Pumping chamber
22 Inlet chamber
24 Lubricant tank
26 Suction opening
28 Outlet chamber
30 Discharge opening
32 Control chamber
34 Lateral slide bearing
36 First lateral slide bearing surface
38 Second lateral slide bearing surface
40 Lateral slide bearing gap
42 Drainage channel
44 Lateral groove
46 Top-side groove
48 Bottom-side groove
50 Top-side slide surface
51 Top-side region (of suction opening 26)
52 Bottom-side slide surface

What is claimed is:

1. A variable displacement lubricant pump for providing a pressurized lubricant, the variable displacement lubricant pump comprising:

a static pump housing;

a control ring which is arranged within the static pump housing, the control ring being configured to be shiftable and to radially confine a pumping chamber which is substantially cylindrical, the control ring comprising a drainage channel;

an inlet chamber which is partially confined by the control ring;

an outlet chamber which is partially confined by the control ring, the outlet chamber and the inlet chamber being arranged at opposite lateral sides of the control ring; and a lateral slide bearing which is arranged at the lateral side of the control ring where the outlet chamber is arranged, the lateral slide bearing comprising, a first lateral slide bearing surface which is defined by the static pump housing, a second lateral slide bearing surface which is arranged opposite to the first lateral slide bearing surface and which is defined by the control ring, and a lateral slide bearing gap which is defined between the first lateral slide bearing surface and the second lateral slide bearing surface, wherein, the drainage channel of the control ring fluidically connects the lateral slide bearing gap with the inlet chamber.

2. The variable displacement lubricant pump as recited in claim 1, wherein, the drainage channel is partially defined by a lateral groove, the lateral groove is arranged within the second lateral slide bearing surface of the control ring, and the lateral groove is fluidically connected with the inlet chamber.

3. The variable displacement lubricant pump as recited in claim 2, wherein, the control ring further comprises at least one of a top-side slide surface which comprises a top-side groove and a bottom-side slide surface which comprises a bottom-side groove, and at least one of the top-side groove and the bottom-side groove is arranged to fluidically lead into the lateral groove and to partially define the drainage channel.

4. The variable displacement lubricant pump as recited in claim 1, wherein, the control ring further comprises a suction opening which is arranged to fluidically connect the pumping chamber with the inlet chamber, and the drainage channel fluidically leads into the suction opening.

* * * * *